US006110075A

United States Patent [19]

Woodruff

[11] Patent Number: 6,110,075

[45] Date of Patent: Aug. 29, 2000

[54] FINGER AND WRIST EXERCISER

[76] Inventor: Allen C. Woodruff, 1624 Forsyth Rd., Orlando, Fla. 32807

[21] Appl. No.: 09/184,396

[22] Filed: Oct. 31, 1998

Related U.S. Application Data

[60] Provisional application No. 60/063,855, Oct. 31, 1997.

[51] Int. Cl.[7] ..... A63B 23/16; A63B 21/04

[52] U.S. Cl. ..... 482/47; 482/124; 482/129; 482/139; 482/904

[58] Field of Search ..... 482/44, 47–49, 482/121, 122, 124, 129, 139, 904; 601/40; 602/21, 22; 84/465; 4/581–583

[56] References Cited

U.S. PATENT DOCUMENTS

| | | | |
|---|---|---|---|
| 1,016,374 | 2/1912 | Spence | 4/581 |
| 1,239,642 | 9/1917 | Tolley | 4/583 |
| 1,759,348 | 5/1930 | Fishman | 4/583 |
| 2,471,008 | 5/1949 | Pretty | 4/583 |
| 3,820,785 | 6/1974 | Occhipinti et al. | 473/463 |
| 4,730,827 | 3/1988 | Williams | 482/47 |
| 4,750,734 | 6/1988 | Greenfield . | |
| 4,828,249 | 5/1989 | Keating | 482/48 |
| 5,013,030 | 5/1991 | Frins | 482/47 |
| 5,062,625 | 11/1991 | Vonk | 482/48 |
| 5,366,436 | 11/1994 | Gibney | 482/47 |
| 5,674,159 | 10/1997 | Davidson | 482/904 |

FOREIGN PATENT DOCUMENTS

| | | | |
|---|---|---|---|
| 68844 | 12/1913 | Switzerland | 482/47 |

*Primary Examiner*—Glenn E. Richman
*Assistant Examiner*—Victor K. Hwang
*Attorney, Agent, or Firm*—Felsman Bradley Vaden Gunter & Dillon LLP; James E. Bradley

[57] ABSTRACT

A portable finger and wrist exerciser has a strap and an elastic tube extending from the strap. The elastic tube is attached to one end of a flat elastic sheet. The elastic sheet has symmetrically spaced apart apertures which are marked with numbers and symbols. A second elastic tube is secured an opposite end of the sheet and formed into a large loop. A variety of exercises may be performed with the exerciser by mounting the strap to a stationary object. The user inserts one arm through the loop and positions himself for a desired tension in the elastic sheet. The user inserts the fingers of the other arm into selected apertures and exercises the fingers, hand and wrist by performing various movements.

12 Claims, 2 Drawing Sheets

FINGER AND WRIST EXERCISER

This application claims the benefit of U.S. Provisional Application Ser. No. 60/063,855, filed Oct. 31, 1997.

TECHNICAL FIELD

This invention relates in general to exercise equipment and in particular to a portable finger and wrist exerciser.

BACKGROUND OF THE INVENTION

Individuals who incur finger, hand, wrist or forearm injuries such as carpal tunnel syndrome, are often in need of physical rehabilitation to strengthen and retain the full use of the injured or repaired body part. One method of rehabilitation includes the gradual increase of resistance-type exercises for the fingers and hands. Although there are several prior art devices which are designed to accomplish this goal, they have their shortcomings.

One such device is described in U.S. Pat. No. 4,750,734. This device has a square or circular rigid frame across which is stretched an elastic membrane. The membrane has holes through which a user may insert his fingers and stretch the membrane to rehabilitate the injured body part. Although this design is workable, it is limited to a single level of resistance and a small set of exercises.

SUMMARY OF THE INVENTION

A portable finger and wrist exerciser has a strap and an elastic tube extending from the strap. The elastic tube is attached to one end of a flat elastic sheet. The elastic sheet has symmetrically spaced apart apertures which are marked with numbers and symbols. A second elastic tube is secured an opposite end of the sheet and formed into a large loop. A variety of exercises may be performed with the exerciser by mounting the strap to a stationary object. The user inserts one arm through the loop and positions himself for a desired tension in the elastic sheet. The user inserts the fingers of the other arm into selected apertures and exercises the fingers, hand and wrist by performing various movements.

BEST MODE FOR CARRYING OUT THE INVENTION

Figure 1:
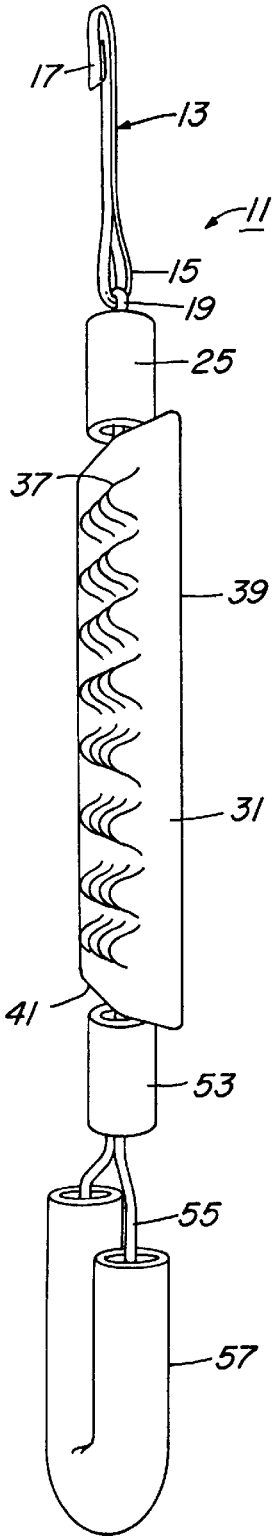
FIG. 1 is an isometric view of an exercise apparatus that is constructed in accordance with the invention.
Figure 2:
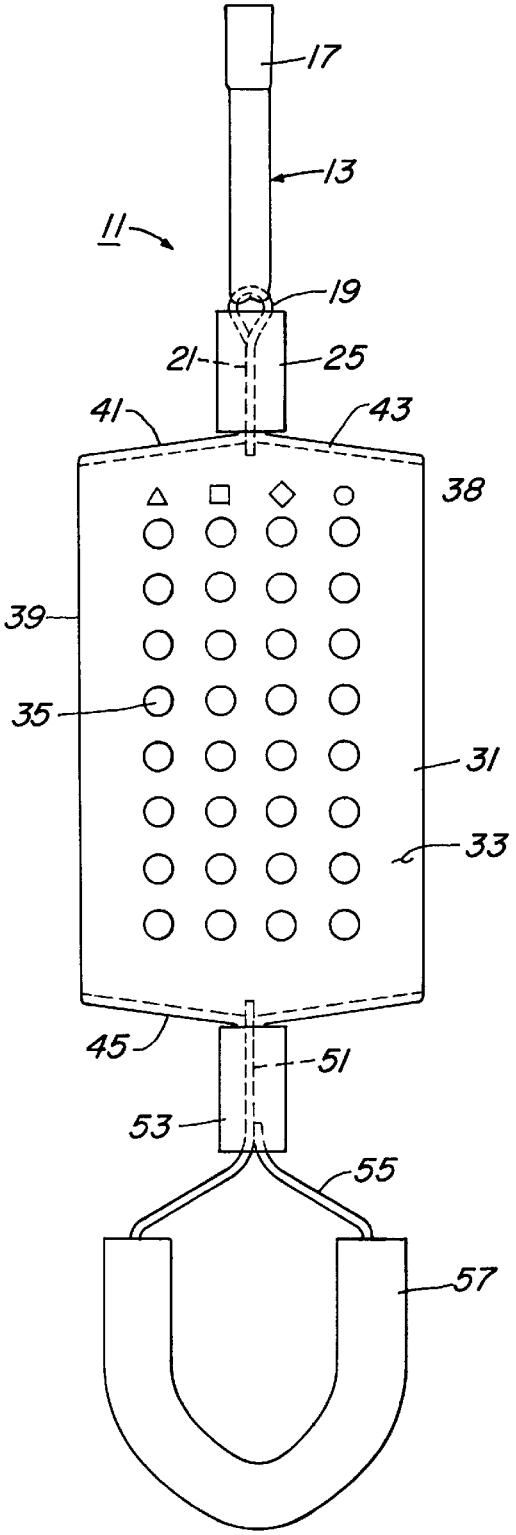
FIG. 2 is a side view of the apparatus of FIG. 1.

Referring to FIGS. 1 and 2, a portable finger and wrist exercise apparatus 11 is shown. Apparatus 11 has a flat attachment strap 13 that is folded in half to form a small loop 15. Loop 15 is approximately six inches long when in a flattened position. In the preferred embodiment, strap 13 is approximately one inch wide and is fabricated from nonelastic, braided nylon. The two ends pieces of strap 13 are placed together, folded over on one another and sewn so that a "T" is formed on a forward end 17 of strap 13. The rearward end of loop 15 receives a loop 19 of a highly elastic, rubberized tube 21 (FIG. 2). Tube 21 is approximately three-eighths of an inch in diameter. Loop 19 is formed by clamping tube 21 to itself. A foam rubber pad 25 is located around each clamp on tube 19. Pad 25 is a short, cylindrical tube with a small axial hole and has a outside diameter of approximately 1.5 inches. Tube 21 is inserted through the axial hole in pad 25 which has a diameter that is approximately equal to the outside diameter of tube 21 so that a tight frictional fit is achieved.

Apparatus 11 also comprises a generally rectangular elastic sheet 31. Sheet 31 is preferably formed from latex and has a flat upper side 33 with a plurality of symmetrically spaced apart apertures or openings 35. Openings 35 extend through sheet 31 and form dimples or protrusions 37 on a lower side of sheet 31. Openings 35 and protrusions 37 are symmetrically arrayed in a plurality of rows and columns. When viewed from its lower side, sheet 31 has the appearance of egg crate material.

Openings 35 are marked with numbers and symbols 38 on surface 33. Numbers and symbols 38 may comprise single digit numbers, triangles, squares, diamonds, circles or the like. Numbers and symbols 38 are located immediately adjacent to openings 35, preferably above openings 35.

Sheet 31 has two longitudinal sides 39 and two transverse sides 41. Longitudinal sides 39 are unsupported. A pair of generally straight, rigid braces 43, 45 are secured to transverse sides 41 along the perimeter of sheet 31. Braces 43, 45 give transverse sides 41 a rigid appearance and keep sheet 31 from rolling up or twisting. A rearward end of tube 21 is secured to a midportion of brace 43.

A rearward end of a second tube 51 is secured to the midportion of brace 45. Tube 51 comprises the same material and diameter as tube 21. A second pad 53 surrounds tube 51 adjacent to brace 45. Pad 53 is identical to pad 25. The forward end of tube 51 is formed into a large loop 55 and clamped to itself inside pad 53. Loop 55 is approximately eighteen inches in diameter. A collar pad 57 is located on the forward end of loop 55. Pad 57 is longer than pads 25, 53, but is otherwise identical. Pad 57 has a hole with a diameter that is approximately equal to the outside diameter of tube 51 so that a tight frictional fit is achieved.

Figure 3:
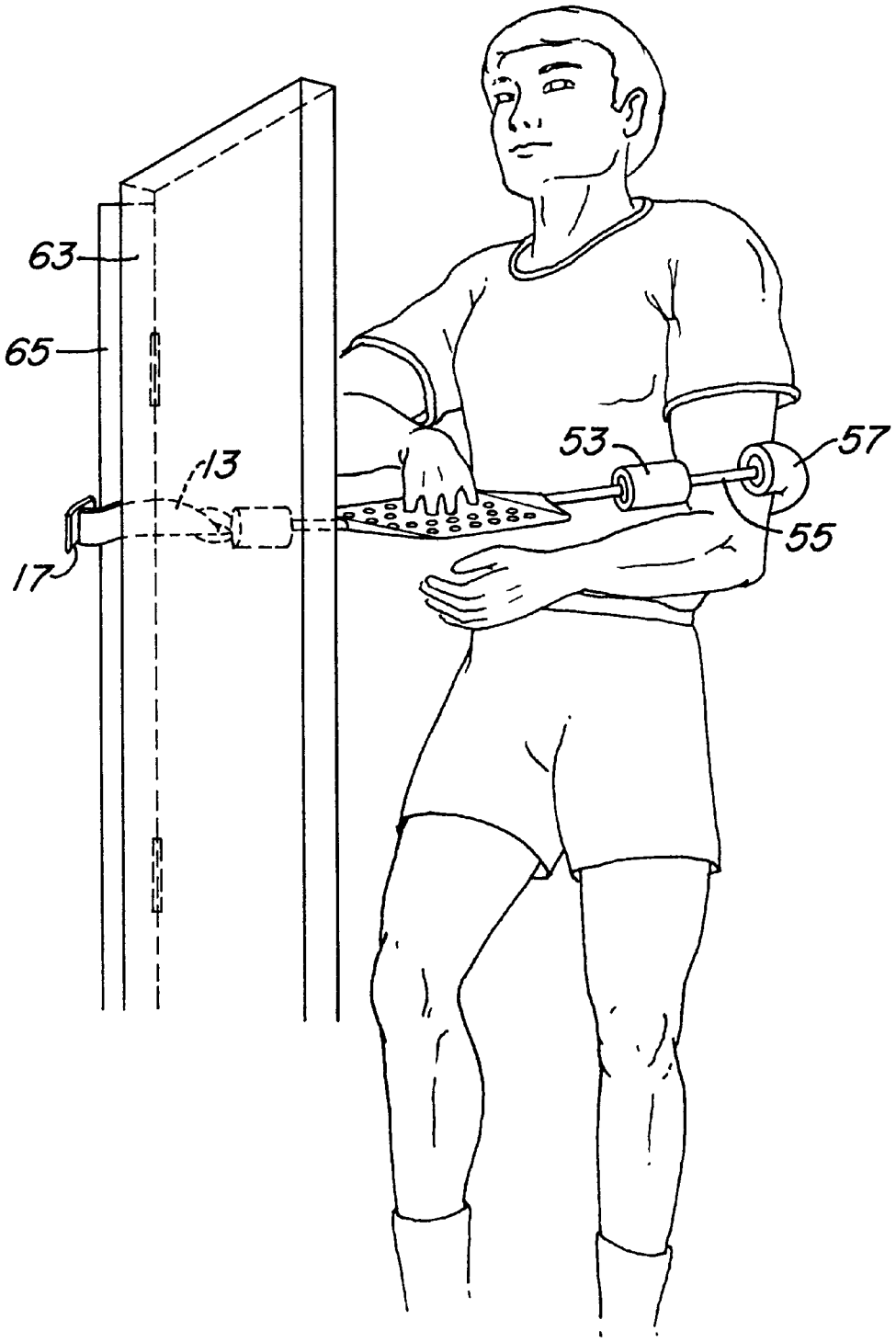
FIG. 3 is a schematic view of the apparatus of FIG. 1 in operation.

In operation, a variety of exercises may be performed by using apparatus 11. FIG. 3 illustrates one such exercise. In order to anchor apparatus 11, T-end 17 is inserted between the hinged side 63 of an open door 61 and its inner door jamb 65. For this particular exercise, strap 13 should be located above the user's waist while standing. Door 61 is then closed and locked from the user's side. When door 61 is closed, strap 13 will be squeezed between door 61 and door jamb 65 and held in place. Strap 13 will be retained in this position until door 61 is reopened and T-end 17 is removed. When properly installed, the cross bar portion of T-end 17 will be on one side of door 61 and the remainder of strap 13 and apparatus 11 will be on the other. Alternatively, apparatus 11 may also be anchored by placing loop 15 over a bar or pole (not shown).

After apparatus 11 is installed, the user inserts one arm through loop 55. Pad 57 should be comfortably positioned around the triceps, just above the elbow. The user may reposition himself relative to door 61 for desired tension in sheet 31. The more tension that is applied to sheet 31, the more rigid or taut it becomes. While maintaining an upright back position and holding the forearm of the inserted arm parallel to the floor, the user inserts the fingers of the other arm into selected openings 35 until the tips of the fingers bottom out in protrusions 37. The fingers can be exercised by moving them toward each other and spreading them apart while holding the wrist stationary.

In order to vary the resistance applied to the fingers, numbers and symbols 38 may be used to define a precise regimen of exercises. For example, in one exercise the user may insert fingers into openings 35 labeled with "1's" and diamonds before squeezing and flexing the fingers, while in another exercise openings 35 labeled with "2's" and squares may be chosen. Alternatively, the wrist and forearm may be exercised by moving them around while holding the fingers stationary within protrusions 37. These movements exercise the fingers, wrist, forearm, upper arm and shoulder of the inserted arm. Other exercises, including rhomboid pulls, inner thoracic pulls and external rotations may be performed with apparatus 11. Most exercises are performed while the user is in a standing position. The exercise illustrated in FIG. 3 may be performed while seated or standing. In addition, the user will experience a slight amount of traction or pull on the fingers when they are removed from openings 35.

The invention has several advantages. This device can do exercises for not only the fingers and wrists such as carpal tunnel, but also for the elbow, shoulder and thoracic retractors for correcting postural problems associated with carpal tunnel. One cord may be used for all levels of resistance. After the device is installed, the resistance can be increased by moving away from the anchor point and stretching the cord, or decreased by moving toward the anchor point and shortening the cord. The openings in the device are also numbered and labeled so that a precise regimen of exercises may be prescribed.

While the invention has been shown or described in only some of its forms, it should be apparent to those skilled in the art that it is not so limited, but is susceptible to various changes without departing from the scope of the invention.

I claim:

1. An exercise apparatus comprising:

a mounting member having a mounting end and an attachment end, the mounting member adapted to be mounted to a stationary object, wherein the mounting member comprises an inelastic fabric strap having one end sewn into a T-shaped configuration so as to be insertable between a door and a door frame;

a loop which is adapted to receive an arm of a user, the loop having a terminal end; and an elastic sheet having a first end secured to the terminal end of the loop, a second end secured to the mounting member and a plurality of apertures, each of which is adapted to receive a finger of the user for exercise thereof, and wherein the sheet is stretchable by pulling the first end away from the second end to vary the tautness of the sheet.

2. An exercise apparatus comprising:

a mounting member having a mounting end and an attachment end, the mounting member adapted to be mounted to a stationary object;

a loop which is adapted to receive an arm of a user, the loop having a terminal end; and an elastic sheet having a first end secured to the terminal end of the loop, a second end secured to the mounting member and a plurality of apertures, each of which is adapted to receive a finger of the user for exercise thereof, wherein the loop and the elastic sheet are formed from elastomeric materials and the sheet is stretchable by pulling the first end away from the second end to vary the tautness of the sheet.

3. The apparatus of claim 2 wherein each of the apertures comprises an opening to a dimple.

4. The apparatus of claim 1, further comprising a rigid brace mounted on each end of the elastic sheet to prevent it from rolling up or twisting.

5. An exercise apparatus comprising:

an elastic sheet having a first end, a second end and a plurality of openings, each of the openings terminating in a dimple which is adapted to receive a finger of the user for exercise thereof, and a loop having a terminal end secured to the first end of the sheet, the loop adapted to receive an arm of a user, wherein the loop is formed from an elastic material and the sheet is stretchable by pulling the first end away from the second end to vary the tautness of the sheet.

6. The exercise apparatus of claim 5 wherein the second end of the sheet is secured to a mounting member.

7. The exercise apparatus of claim 5, further comprising a mounting member having a mounting end which is adapted to be mounted to a stationary object, and an attachment end secured to the second end of the sheet.

8. The apparatus of claim 5, further comprising an inelastic fabric strap having one end sewn into a T-shaped configuration and adapted to be inserted between a door and a door frame, and an attachment end secured to the second end of the sheet.

9. The apparatus of claim 5, further comprising a rigid brace mounted on each end of the elastic sheet to prevent it from rolling up or twisting.

10. The exercise apparatus of claim 5 wherein the sheet has a flexible perimeter.

11. A method of exercising comprising:

(a) providing an elastic sheet having a plurality of apertures and having a mounting strap secured to a first end thereof;

(b) securing the first end of the sheet to a stationary object by inserting the mounting strap between an open door and its adjacent door frame and closing the door;

(c) pulling a second end of the sheet away from the first end to stretch the sheet to a desired level of tension; and (d) inserting fingers into apertures in the sheet and moving the fingers in a repetitive motion while they are engaged in the apparatus.

12. A method of exercising comprising:

(a) providing an elastic sheet having a plurality of apertures;

(b) securing a first end of the sheet to a stationary object;

(c) inserting an arm through a loop secured to a second end of the sheet and pulling the second end of the sheet away from the first end to stretch the sheet to a desired level of tension: and (d) inserting fingers into apertures in the sheet and moving the fingers in a repetitive motion while they are engaged in the apertures.

* * * * *